United States Patent [19]

Franklin et al.

[11] Patent Number: 5,020,463

[45] Date of Patent: Jun. 4, 1991

[54] ARRANGEMENT FOR RAISING OR LOWERING BOATS OR THE LIKE

[76] Inventors: Robert E. Franklin, HCR 67, Box 2576, Jamaica, Va. 23079; Philip L. Hill, IV, Rte. 2, Box 5, Rockville, Va. 23146

[21] Appl. No.: 452,171

[22] Filed: Dec. 18, 1989

[51] Int. Cl.[5] ..... B63B 21/00

[52] U.S. Cl. ..... 114/230; 114/373; 405/3

[58] Field of Search ..... 405/3; 114/44, 368, 114/369, 373, 230; 254/283, 284, 285, 286

[56] References Cited

U.S. PATENT DOCUMENTS

| | | | |
|---|---|---|---|
| 2,529,948 | 11/1950 | Jones | 405/3 |
| 2,829,781 | 4/1958 | Nomsen | 114/230 X |
| 3,109,185 | 11/1963 | Miller | 9/34 |
| 3,151,595 | 10/1964 | Stainbrook | 114/230 |
| 3,218,034 | 11/1965 | Schat | 254/172 |
| 3,289,627 | 12/1966 | Frederick | 114/230 |
| 3,360,144 | 12/1967 | D'Estrube | 214/450 |
| 3,804,263 | 4/1974 | Castonguay | 212/65 |
| 3,961,713 | 6/1976 | Stine | 212/58 R |
| 3,967,570 | 7/1976 | Bradfield | 114/45 |
| 4,109,896 | 8/1978 | Ragen | 254/144 |
| 4,139,110 | 2/1979 | Roberts | 214/450 |
| 4,627,377 | 12/1986 | Zoonens | 114/373 |
| 4,637,770 | 1/1987 | Swadell | 414/495 |
| 4,686,920 | 8/1987 | Thomas | 114/48 |
| 4,699,075 | 10/1987 | Tortorici | 114/230 |
| 4,763,593 | 8/1988 | Lasko | 114/44 |
| 4,764,081 | 8/1988 | Peterson | 114/44 X |

*Primary Examiner*—Sherman D. Basinger

*Attorney, Agent, or Firm*—Branigan & Butler Griffin

[57] ABSTRACT

An adjustable davit arrangement is attachable to a pair of pier pilings for raising or lowering a vessel and comprises a first davit mounted on a first pier piling, a second davit mounted on a second pier piling, a rotatable drive pipe extending between respective distal ends of the first and second davits, pick-up flanges disposed near respective ends of the rotatable drive pipe for raising or lowering the vessel via respective cables as the drive pipe is rotated, and a winch motor mounted in proximity to one of the davits and operating with a gear reducing drive drum mounted on the drive pipe so as to cause the drive pipe to rotate, thereby raising or lowering the vessel. Simplicity in assembly and operation, and economy, are achieved by use of a single winch motor. Flexibility in raising boats of various sizes to a desired height above the pier decking, while maintaining a desired lateral distance between the edge of the pier decking and the boat, is achieved by use of adjustable davits having extension arms telescopically slidable in a support arm, in conjunction with adjustable knee braces associated with each davit. The risk of breaking pier pilings is reduced or eliminated by employing a stanchion mounted along the lengthwise dimension of each pier piling, thereby distributing the lifting forces along the length of each pier piling.

12 Claims, 2 Drawing Sheets

ARRANGEMENT FOR RAISING OR LOWERING BOATS OR THE LIKE

TECHNICAL FIELD

The invention generally relates to an arrangement which is attachable to a pair of pier pilings for raising or lowering boats or the like. In particular, the invention relates to an adjustable boat davit arrangement which can be mounted to pier pilings for raising small boats above the level of the pier decking.

BACKGROUND ART

Various arrangements for raising or lowering boats at a pier having existed in the prior art. However, such arrangements have been burdened by numerous disadvantages.

Notably, such prior art arrangements have been overly complicated to assemble, and have involved the employment of an excess of hardware. In addition, such arrangements of the prior art have not been adjustable, and thus such arrangements have not been suitable for each and every pier piling situation encountered. Moreover, such arrangements have not been adjustable to the point where boats of different beams (widths) are accommodated.

Furthermore, the design of such prior art arrangements has been such as to place an excessive force on pier pilings on which the arrangement is mounted so that, once the lifting procedure begins or once the lifting procedure has been carried out a certain number of times, a stress failure of the pier pilings has developed, resulting in damage to the boat being lifted and possible injury to the individuals participating in the boat lifting operation.

The following U.S. Pat. Nos. are considered to be representative of the prior art relative to the invention disclosed herein: 3,109,185; 3,218,034; 3,289,627; 3,360,144; 3,804,263; 3,961,713; 3,967,570; 4,109,896; 4,139,110; 4,627,377; 4,637,770; 4,686,920; 4,699,075; and 4,763,593.

DISCLOSURE OF INVENTION

The invention generally relates to an arrangement which is attachable to a pair of pier pilings for raising or lowering a boat or similar vessel.

In particular, the invention relates to an adjustable davit arrangement which can be mounted to pier pilings regardless of the configuration of the pier pilings, which can accommodate boats of various beams (widths), and which is capable of raising and lowering a boat to a desired height above the pier decking while maintaining a desired lateral distance between the pier and the boat.

In a preferred embodiment, the arrangement comprises first and second davits mountable on first and second pier pilings, respectively, a rotatable drive pipe extending between remote ends of the first and second davits, pick-up flanges disposed on or near respective ends of the rotatable drive pipe, and a winch motor mounted on one of the pier pilings and connected by a line or cable to a gear reducing drive drum mounted on or near a corresponding end of the rotatable drive pipe. Each davit also includes an adjustable extension member extending between the pier piling and the rotatable drive pipe.

By employing an adjustable extension member between each pier piling and the drive pipe, the lifting arrangement provides complete flexibility in use, thereby permitting boats of various widths to be lifted to points of various height above the pier decking. In addition, by employing a single motor associated with one of the davits to drive the rotatable drive pipe, the arrangement is simple to assemble, ease to operate, and relatively inexpensive to assemble, operate and maintain. Finally, the unique construction of the davit mounted on each pier piling minimizes or even eliminates the possibility of damage to the pier piling due to repeated lifting of boats with the arrangement in that, during the lifting operation, the forces involved are distributed throughout the length, or a portion of the length, of the pier piling.

Therefore, it is a primary object of the present invention to provide an arrangement for raising or lowering a boat or similar vessel at the side of a pier.

It is an additional object of the present invention to provide an arrangement which is attachable to a pair of pier pilings for raising or lowering a boat or similar vessel.

It is an additional object of the present invention to provide a lifting arrangement powered by a single drive motor which is associated with one of the davits.

It is an additional object of the present invention to provide a lifting arrangement which is adjustable so as to accommodate different pier situations and different size boats.

It is an additional object of the present invention to provide a lifting arrangement which employs davits of such a design as to distribute the lifting forces along the length, or a substantial portion of the length, of the pier pilings, thereby avoiding unnecessary damage to the pier pilings during the lifting operation.

The above and other objects of the invention, as will hereinafter appear, and the nature of the invention will be more fully understood by reference to the following detailed description and the accompanying drawings.

BEST MODE FOR CARRYING OUT THE INVENTION

The invention will now be described in more detail with reference to the accompanying drawings.

Figure 1:
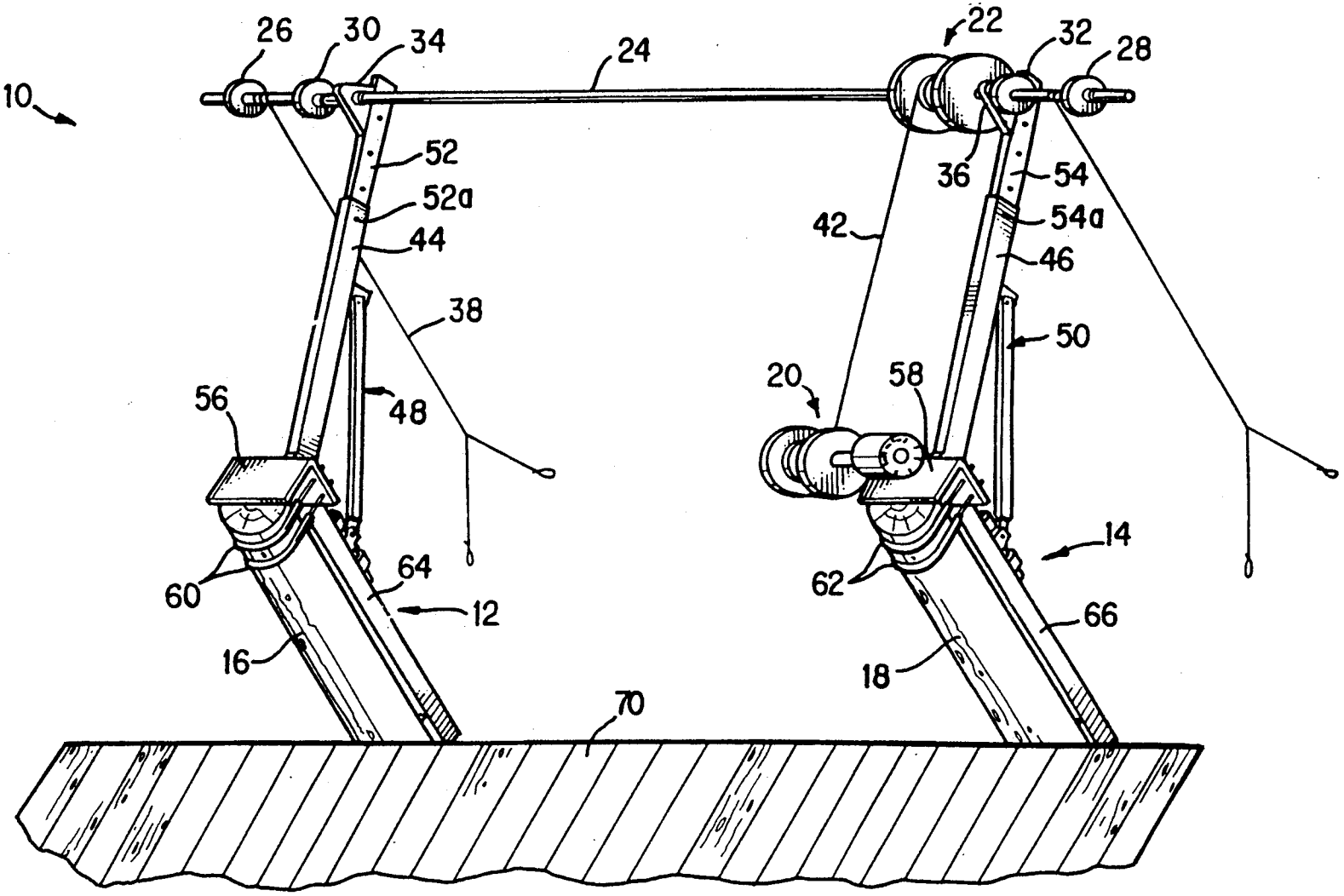
FIG. 1 is perspective view of the lifting arrangement of the present invention.
Figure 2:
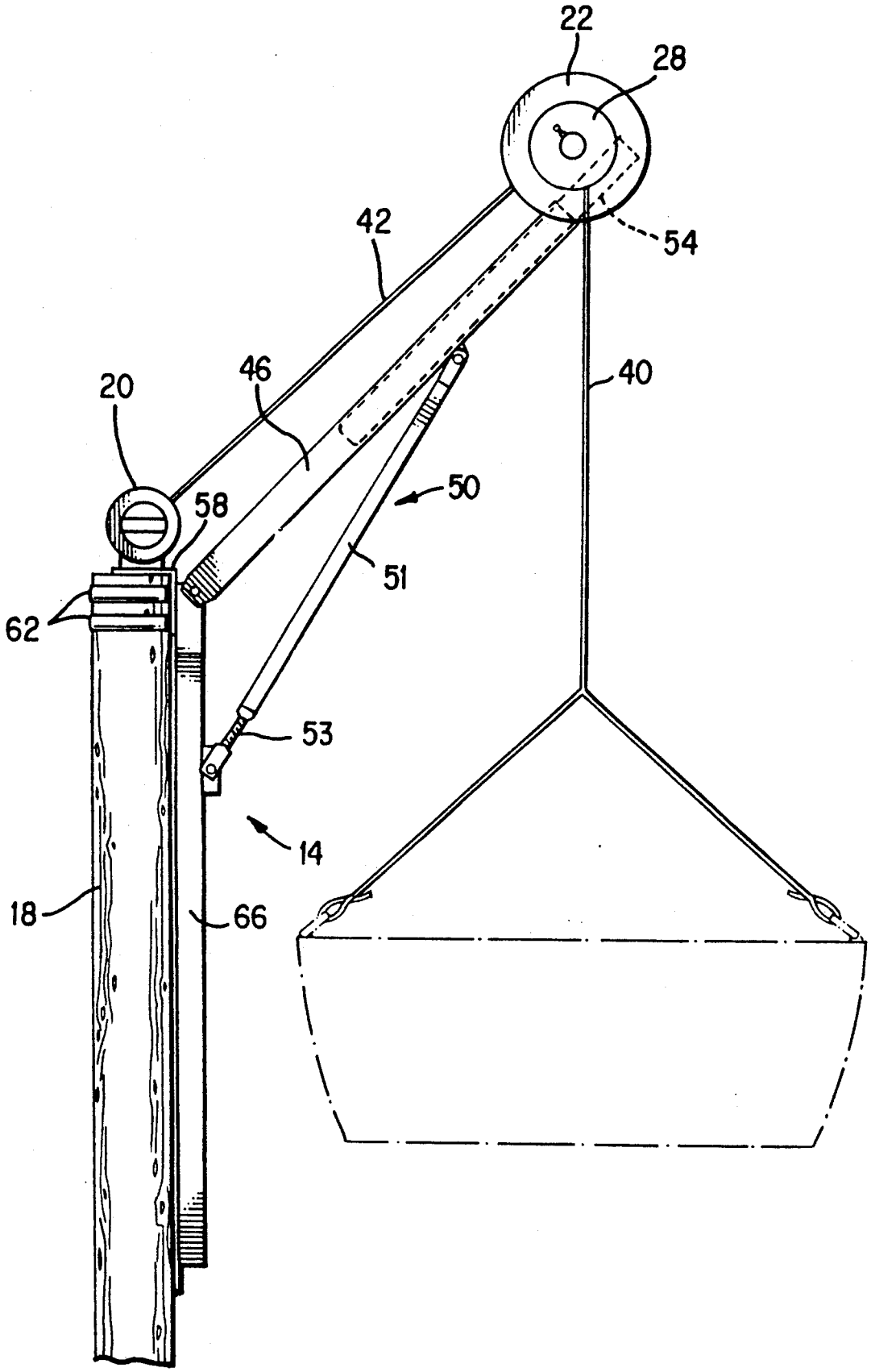
FIG. 2 is a side view of the davit mounted on a given pier piling and employed as a part of the lifting arrangement of the present invention.

As stated above, FIG. 1 is a perspective view of the lifting arrangement of the present invention, while FIG. 2 is a side view of a davit mounted on a given pier piling as a part of the lifting arrangement.

As seen in FIG. 1, the lifting arrangement 10 generally comprises adjustable davits 12 and 14 mounted on pier pilings 16 and 18, respectively, such pier pilings 16 and 18 being located at the edge of pier decking 70. The lifting arrangement 10 further comprises a winch motor 20 mounted on adjustable davit 14 in association with pier piling 18, a gear reducing drive drum 22, drive pipe 24, pick-up flanges 26 and 28 mounted on the ends of drive pipe 24, and guide flanges 30 and 32 mounted inboard of the pick-up flanges 26 and 28, respectively, on the drive pipe 24.

Adjustable davit 12 comprises support arm 44, adjustable knee brace 48, and extension arm 52 telescopically mounted inside and slidable within the support arm 44, while adjustable davit 14 correspondingly comprises support arm 46, adjustable knee brace 50, and extension arm 54 telescopically mounted inside and slidable within the support arm 56. Extension arms 52 and 54 are provided with pillow blocks 34 and 36, respectively, the pillow blocks 34 and 36 serving to hold the drive pipe 24 and retain it in proper alignment. Preferably, pillow blocks 34 and 36 are of the type containing self-aligning bearings so as to facilitate setup of the arrangement 10 for operation.

Drive pipe 24 is preferably approximately 1.5 inches in diameter, and the gear reducing drive drum 22 mounted on drive pipe 24 is centered directly in front of the winch motor 20 which is mounted on adjustable davit 14 via flange plate 58, the flange plate 58 being secured to the pier piling 18 by means of a pair of mounting brackets 62 (preferably, a pair of $\frac{1}{4} \times 1$ mounting brackets). Adjustable davit 12 is also provided with a flange plate 56, that arrangement being secured to pier piling 16 by means of a pair of mounting brackets 60.

Adjustable davits 12 and 14 also include stanchions 64 and 66, respectively, each stanchion being, preferably, a five-foot stanchion welded to its respective flange plate 56 or 58.

During assembly of the lifting arrangement 10, flange plates 56 and 58 with stanchions 64 and 66, respectively, welded thereto are attached to pilings 16 and 18, respectively, using the mounting brackets 60 and 62, respectively. As shown in FIG. 1, stanchions 64 and 66 extend beneath the upper surface of the pier decking 70. Extension arms 52 and 54 are positioned inside support arms 44 and 46, respectively, and support arms 44 and 46 are attached to stanchions 64 and 66, respectively, using nuts and bolts. Adjustable knee braces 48 and 50 are assembled between support arms 44 and 46, respectively, on the one hand, and stanchions 64 and 66, respectively on the other hand by using nuts and bolts.

The remote or distal portions of davits 12 and 14 (that is, pillow blocks 34 and 36, respectively) are then properly aligned, and drive pipe 24 is inserted through pillow blocks 34 and 36, the drive drum 22 being centered in front of winch motor 20, the winch motor 20 being bolted to the top of the flange plate 58. A predetermined length (preferably, about forty feet) of cable 42 is wound on drive drum 22 and the end of the cable 42 is attached to winch motor 20.

Pick-up flanges 26 and 28 are attached to drive pipe 24 by use of set screws (not shown), flanges 26 and 28 being centered over the pick-up points on the boat to be lifted. Predetermined lengths (preferably about fifteen feet) of cable 38 and 40 are attached to pick-up flanges 26 and 28, respectively. Guide flanges 30 and 32 are attached to drive pipe 24.

It is to be noted that FIG. 1 shows one embodiment of the invention wherein pick-up flanges 26 and 28 are mounted outboard of guide flanges 30 and 32, respectively. Other embodiments are possible and are within the scope of this disclosure. For example, pick-up flanges 26 and 28 can be mounted inboard of guide flanges 30 and 32, respectively; this is advisable when a relatively heavy load is to be lifted. Alternatively, pick-up flange 26 can be mounted outboard of guide flange 30 and pick-up flange 28 mounted inboard of guide flange 32, or vice-versa.

The assembly is completed by adjustment of davits 12 and 14 so as to achieve desired alignment. That is to say, extension arms 52 and 54 are slidably extended from within support arms 44 and 46, respectively, and are locked into place by locking bolts **52*a* and 54*a*, respectively. In addition, knee braces 48 and 50 are adjusted by rotating a yoke on each knee brace 48 and 50, respectively. In the latter regard, as seen in FIG. 2, knee brace 50 comprises a yoke 51 (having a threaded interior) and an externally threaded member 53. Rotation of yoke 51 in one direction lengthens knee brace 50, while rotation of yoke 51 in the other direction shortens knee brace 50. The same applies to knee brace 48 of FIG. 1**.

In operation, the cables 38 and 40 from each of pick-up flanges 26 and 28 are attached to the bow and stern, respectively, of the boat to be lifted by using conventional connection methods. Winch motor 20 is energized by appropriate means (for example, by use of a twelve-volt power source). Once winch motor 20 is turned on, it reels in cable 42 from drive drum 22, thereby turning drive drum 22 and drive pipe 24 connected thereto. Rotation of drive pipe 24 results in rotation of pick-up flanges 26 and 28, respectively, and cables 38 and 40, respectively, are reeled in by pick-up flanges 26 and 28, respectively. As a result, the boat connected to cables 38 and 40 is lifted. Reverse operation of winch motor 20 results in lowering of the boat.

It is to be noted that, as the drive pipe 24 and pick-up flanges 26 and 28 turn, cables 38 and 40 are wound around pipe 24 in the embodiment shown. However, other known techniques for receiving cables 38 and 40 can be employed.

It is also to be recognized that, as a result of the unique design of adjustable davits 12 and 14, forces due to the weight of the boat being lifted are distributed uniformly over the length (or at least five feet) of each pier piling 16 and 18, such forces being distributed via support arms 44 and 46, knee braces 48 and 50, and stanchions 64 and 66.

In addition, since each davit 12 and 14 is adjustable via extension or retraction of extension arms 52 and 54 in combination with adjustment of the length of knee braces 48 and 50, boats of various beams (widths) can be lifted, boats being lifted can be maintained at a desired lateral distance from pier decking 70, and boats can be lifted to various desired heights above pier decking 70.

Finally, the employment of a single winch motor 20 mounted on pier piling 18 (which can be nearest the bow or stern of the boat, although the stern is preferred) not only simplifies the assembly and operation of the lifting arrangement 10, but also makes the arrangement less expensive to obtain and employ. The use of a winch motor 20 driven by a twelve-volt power source is preferable because it eliminates expensive wiring associated with alternating current (AC) power sources. The use of a gear reducing drive drum 22 is preferred because it enables the winch motor 20 to lift a broad range of loads. Finally, whereas FIG. 1 shows one embodiment wherein winch motor 20 and drive drum 22 are located inboard of pier piling 18, winch motor 20 and drive drum 22 could also be positioned outboard of pier piling 18 (or inboard or outboard of pier piling 16). However, as mentioned previously, positioning of motor 20 and winch 22 in proximity to the stern of the vessel to be lifted is preferred.

While preferred forms and arrangements have been shown in illustrating the invention, it is to be understood that various changes in detail and arrangement may be made without departing from the spirit and scope of this disclosure.

I claim:

1. An arrangement which is attachable to a pier for raising or lowering a vessel while the orientation of said vessel remains substantially unchanged, said pier including a first and a second pier piling and a pier decking having an upper surface, said first and second pier pilings each being substantially vertically oriented, said first and second pier pilings each including an upper projection above said upper surface of said pier decking and a lower extension beneath said upper surface of said pier decking, said arrangement comprising:

a first and a second stanchion respectively mounted substantially vertically on each of said first and second pier pilings along said upper projection and further at least along a portion of said lower extension;

a first and a second davit each having a near end mounted on said first and second stanchion respectively, each of said first and second davits having a far end disposed substantially vertically above said vessel while said vessel is being raised or lowered;

a rotatable drive axle extending between respective said far ends of said first and second davits;

self-aligning bearing means mounted on each of said first and second davits proximally to each respective said far end to rotatably bear said rotatable drive axle;

first and second pick-up means disposed on said rotatable drive axle for raising or lowering said vessel; and electrical motor means operatively associated with one of said first and second davits and with said rotatable drive axle for rotating said rotatable drive axle so as to cause said first and second pick-up means to raise or lower said vessel;

whereby said self-aligning bearing means is operative to compensate for misalignments between respective said far ends of said first and second davits;

wherein said rotatable drive axle is disposed at a horizontal distance from said first and second stanchions so that said vessel is maintained at a given lateral distance from said pier.

2. The arrangement of claim 1, wherein each of said first and second davits comprises a support arm extending from said first and second stanchion, respectively, toward said rotatable drive axle, and an extension arm slidably adjustably mounted in an interior of said support arm.

3. The arrangement of claim 2, wherein each of said first and second davits further comprises an adjustable knee brace extending from said first and second stanchion, respectively, to an intermediate point on said support arm, said support arms being upwardly pivotably mounted on said first and second stanchions, respectively.

4. The arrangement of claim 1, wherein said electrical motor means comprises a winch motor mounted in proximity to one of said first and second davits, said arrangement further comprising a gear reducing drive drum mounted on said rotatable drive axle and a cable extending between said gear reducing drive drum and said winch motor.

5. The arrangement according to claim 1, wherein said electrical motor means comprises a winch motor energizable by a twelve-volt d.c. power source.

6. The arrangement according to claim 1, wherein each of said first and second pick-up means includes a cable for raising and lowering said vessel, said cable having a first and a second end, each of said first and second pick-up means including a guide flange and a pick-up flange spaced apart along a length portion of said rotatable drive axle, said pick-up flange having attached thereto said first end of said cable, said guide flange and said pick-up flange being operative in guiding said cable therebetween while said cable is wound about said length portion of said rotatable drive axle, said second ends of said cables of said first and second pick-up means being adapted for attachment to said vessel so that the entire weight of the vessel is cooperatively supportable by said second ends.

7. The arrangement according to claim 1, wherein said rotatable drive axle comprises a pipe.

8. An arrangement which is attachable to a pier for raising or lowering a vessel while the orientation of said vessel remains substantially unchanged, said pier including a first and a second pier piling and a pier decking, said first and second pier pilings each being substantially vertically oriented, said first and second pier pilings each including an upper projection above said pier decking and a lower extension beneath said pier decking, said arrangement comprising:

a first and a second stanchion respectively mounted substantially vertically on each of said first and second pier pilings;

a first and a second davit each having a near end mounted on said first and second stanchion respectively, each of said first and second davits having a far end disposed substantially vertically above said vessel while said vessel is being raised or lowered;

a rotatable drive axle extending between respective said far ends of said first and second davits;

self-aligning bearing means mounted on each of said first and second davits proximally to each respective said far end to rotatably bear said rotatable drive axle;

first and second pick-up means disposed on said rotatable drive axle for raising or lowering said vessel; and electrical motor means operatively associated with one of said first and second davits and with said rotatable drive axle for rotating said rotatable drive axle so as to cause said first and second pick-up means to raise or lower said vessel;

whereby said self-aligning bearing means is operative to compensate for misalignments between respective said far ends of said first and second davits;

wherein said rotatable drive axle is disposed at a horizontal distance from said first and second stanchions so that said vessel is maintained at a given lateral distance from said pier.

9. The arrangement according to claim 8, wherein each of said first and second pick-up means includes a cable for raising and lowering said vessel, said cable having a first and a second end, each of said first and second pick-up means including a guide flange and a pick-up flange spaced apart along a length portion of said rotatable drive axle, said pick-up flange having attached thereto said first end of said cable, said guide flange and said pick-up flange being operative in guiding said cable therebetween while said cable is wound about said length portion of said rotatable drive axle, said second ends of said cables of said first and second pick-up means being adapted for attachment to said vessel so that the entire weight of the vessel is cooperatively supportable by said second ends.

10. The arrangement of claim 8, wherein each of said first and second davits comprises a support arm extending from said first and second pier pilings, respectively, toward said rotatable drive axle, and an extension arm slidably mounted in an interior of said support arm.

11. The arrangement of claim 10, wherein each of said first and second davits further comprises an adjustable knee brace extending from said first and second pier pilings, respectively, to an intermediate point on said support arm.

12. The arrangement of claim 8, wherein said motor means comprises a winch motor mounted in proximity to one of said first and second davits, said arrangement further comprising a gear reducing drive drum mounted on said rotatable drive axle, and a cable extending between said gear reducing drive drum and said winch motor.

* * * * *